United States Patent [19]

Wong et al.

[11] Patent Number: 4,552,219

[45] Date of Patent: Nov. 12, 1985

[54] SUBSURFACE SAFETY VALVE

[75] Inventors: Fred S. Wong, Houston; Larry F. Grohman, Spring, both of Tex.

[73] Assignee: Hydril Company, Los Angeles, Calif.

[21] Appl. No.: 539,333

[22] Filed: Oct. 5, 1983

[51] Int. Cl.[4] ..... E21B 34/10

[52] U.S. Cl. ..... 166/321; 166/324; 166/322

[58] Field of Search ..... 166/319-323, 166/332, 334, 324

[56] References Cited

U.S. PATENT DOCUMENTS

| | | | |
|---|---|---|---|
| Re. 25,471 | 11/1963 | Fredd | 251/31 |
| Re. 26,149 | 1/1967 | Sizer et al. | 166/72 |
| Re. 28,131 | 8/1974 | Leutwyler | 137/629 |
| 2,518,795 | 8/1950 | Knox | 251/163 |
| 2,894,715 | 7/1959 | Bostock | 251/58 |
| 2,908,330 | 10/1959 | Fredd et al. | 166/46 |
| 2,973,005 | 2/1961 | Dollison et al. | 137/459 |
| 2,998,070 | 8/1961 | Tamplen et al. | 166/72 |
| 2,998,077 | 8/1961 | Keithahn | 166/334 |
| 3,002,566 | 10/1961 | Bostock | 166/224 |
| 3,035,808 | 5/1962 | Knox | 251/62 |
| 3,078,923 | 2/1963 | Tausch | 166/224 |
| 3,208,531 | 9/1965 | Tamplen | 166/125 |
| 3,233,860 | 2/1966 | Dollison et al. | 251/62 |
| 3,292,706 | 12/1966 | Grimmer et al. | 166/322 |
| 3,310,114 | 3/1967 | Dollison | 166/224 |
| 3,419,076 | 12/1968 | Sizer et al. | 166/53 |
| 3,509,913 | 7/1967 | Lewis | 136/614.11 |
| 3,583,442 | 6/1971 | Dollison | 137/630.19 |
| 3,627,042 | 12/1971 | McGowen, Jr. | 166/224 |
| 3,642,070 | 2/1972 | Taylor | 166/314 |
| 3,675,720 | 7/1972 | Sizer | 166/314 |
| 3,696,868 | 10/1972 | Taylor, Jr. | 166/315 |
| 3,763,932 | 10/1973 | Dinning | 166/72 |
| 3,771,603 | 11/1973 | Crowe | 166/314 |
| 3,786,863 | 1/1974 | Tausch | 166/72 |
| 3,786,865 | 1/1974 | Tausch | 166/224 |
| 3,786,866 | 1/1974 | Tausch | 166/224 |
| 3,786,867 | 1/1974 | Tausch | 166/315 |
| 3,799,204 | 3/1974 | Watkins | 137/629 |
| 3,799,258 | 3/1974 | Tausch | 166/72 |
| 3,826,462 | 7/1974 | Taylor | 251/58 |
| 3,850,242 | 11/1974 | Crowe | 166/324 |
| 3,860,066 | 1/1975 | Pearce et al. | 116/72 |
| 3,868,995 | 3/1975 | Crowe | 166/224 |
| 3,874,634 | 4/1975 | Gazda | 251/319 |
| 3,896,876 | 7/1975 | Crowe | 166/224 |
| 3,901,321 | 8/1975 | Mott | 166/314 |
| 3,971,438 | 7/1976 | Crowe | 166/322 X |
| 3,993,136 | 11/1976 | Mott | 166/314 |
| 4,019,574 | 4/1977 | Mott | 166/0.5 |
| 4,026,362 | 5/1977 | Mott | 166/314 |
| 4,067,387 | 1/1978 | Mott | 166/156 |
| 4,077,473 | 3/1978 | Watkins | 166/323 |
| 4,082,147 | 4/1978 | Wolff et al. | 166/314 |
| 4,086,935 | 5/1978 | Raulins et al. | 166/321 X |
| 4,249,599 | 2/1981 | Krause | 166/72 |
| 4,253,525 | 3/1981 | Young | 166/321 X |
| 4,354,554 | 10/1982 | Calhoun et al. | 166/321 |

FOREIGN PATENT DOCUMENTS

| | | | |
|---|---|---|---|
| 955915 | 10/1974 | Canada | 251/54 |

*Primary Examiner*—Stephen J. Novosad
*Assistant Examiner*—Thuy M. Bui
*Attorney, Agent, or Firm*—Dodge, Bush & Moseley

[57] ABSTRACT

A tubing retrievable surface controlled subsurface safety valve having a rotatable ball-type flow closure element is disclosed. The ball element is rotationally operated and guided by a pair of guide members fixed in the valve by a stop ring. The guide members co-act with the ball to provide the desired rotational movement as well as providing a movement limit stop to prevent rotational overtravel of the ball. The tubular operator means imparts longitudinal movement to the ball greater than the predetermined movement required to effect the desired ball rotation prior to engaging the stop ring.

A locking sleeve having a longitudinal locking movement greater than the predetermined movement to rotate the ball open is provided. Operating movement of the locking sleeve uncovers a control fluid port for operating a supplemental subsurface valve operably secured with the valve. Prior to activating the locking sleeve to install the supplemental valve, the valve may be controlled through either of two conduits. Only one conduit may be used to operate the supplemental valve.

8 Claims, 12 Drawing Figures

FIG. 3
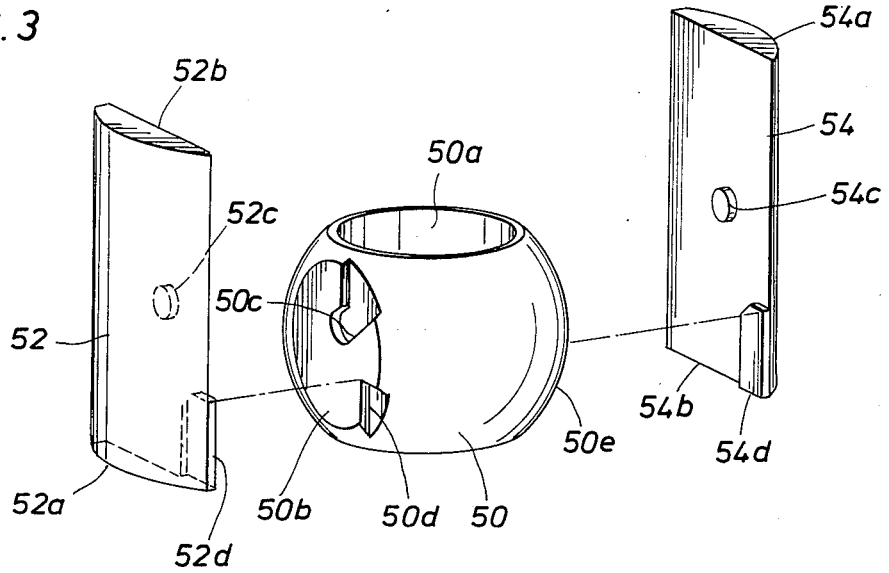
FIG. 4
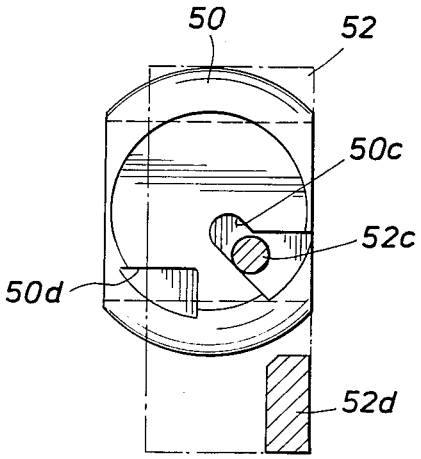
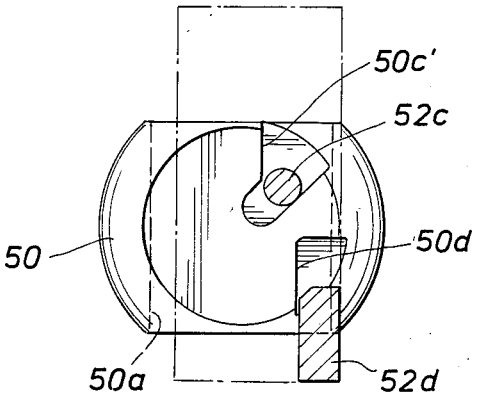
FIG. 5
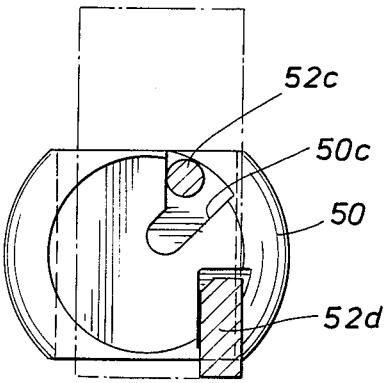
FIG. 6

SUBSURFACE SAFETY VALVE

BACKGROUND OF THE INVENTION

1. Field of the Invention

The present invention relates broadly to the field of safety systems for use in controlling undesired flow of well fluids from hydrocarbon producing wells. Specifically, the present invention relates to an improved simplified construction of a primary rotatable ball-type surface controlled tubing retrievable subsurface safety valve which is procluded from ball rotational overtravel. The ball may be locked open in the event of a primary valve malfunction and a backup surface controlled through the flow line installed subsurface valve operably mounted therein as a redundant safety system.

SUMMARY OF THE INVENTION

The present invention relates to a new and improved subsurface safety valve system for use in hydrocarbon producing wells and particularly to a primary tubing retrievable surface controlled subsurface safety valve. The rotatable ball is flow closure element rotated to and from the open and closed position by longitudinal movement of a prearranged distance and is prevented from over rotation by additional longitudinal movement after desired rotation is achieved by coacting stops. This additional longitudinal movement or operating stroke results from a greatly simplified and thereby economical construction while assuring positive operation. The ball-type flow closure element is normally maintained in the closed upper position by a spring biasing arrangement to provide failsafe operation. When it is desired to open the valve and enable flow through the well tubing, pressure of control fluid communicated to the valve from the surface through a separate control fluid conduit is increased to overcome the spring biasing to move the ball longitudinally to the lower or rotated open position. When desired, the ball may be locked in the open position by shifting a locking sleeve using wire-line operations. The shifted locking sleeve maintains the valve actuator in the lower position to hold the ball in the open position and unseals a flow port to enable communication of control fluid to the flow passage and a supplemental safety valve installed therein.

The ball-type flow closure element is positioned in the flow passage of the tubular housing between a pair of fixed ball guides or operating retainers. Each of the retainers is provided with a crank pin received in a radially extending slot formed on an adjacent chordal flat of the ball. Longitudinal movement of the ball the prearranged longitudinal distance relative to the crank pins effects operating rotation of the ball to align the ball flow port with the valve flow passage and enable the desired flow.

At least one of the ball guides carries a rotation stop shoulder for engaging a co-acting stop shoulder on an adjacent ball flat to limit rotational movement of the ball while enabling additional longitudinal movement of the ball relative to the retainer and crank pins. The guides are dimensioned to be secured to the valve housing in the clearance provided by the ball flats to minimize the diameter of the tubular housing and to greatly simplify manufacturing and assembly of the safety valve. Positive operation to the open position by the ball is assured, since the operator is designed to move longitudinally on the operating stroke a longitudinal distance than that required to rotate the ball open.

BRIEF DESCRIPTION OF THE DRAWINGS

FIG. 3 is an exploded or assembly view of the ball-type closure element and its mounting structure; and FIGS. 4, 5 and 6 are side views of the operating relationship of the ball-type closure element in its mounting structure as the ball-type closure element moves from the closed position (FIG. 4) to the aligned open position (FIG. 5) and to the full stroke open position (FIG. 6).

DESCRIPTION OF THE PREFERRED EMBODIMENT

Figure 1A:
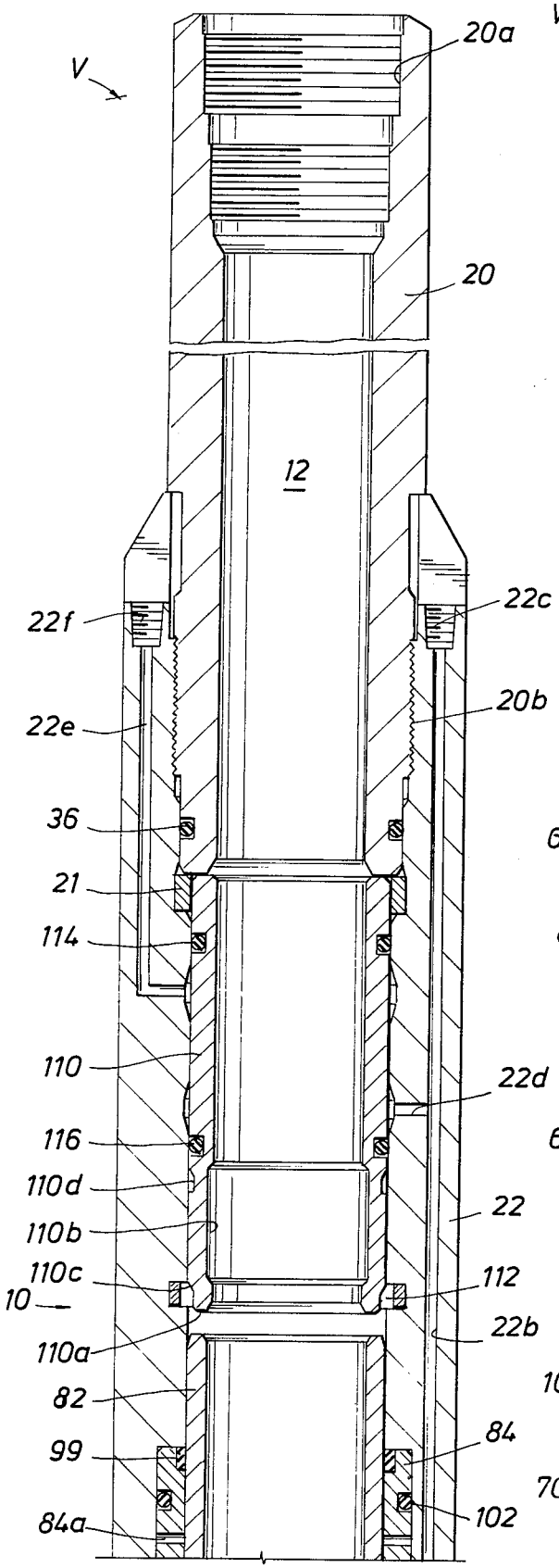
FIGS. 1A, 1B, 1C and 1D are in full section views arranged in alphabetical sequence from top to bottom of a tubing retrievable subsurface safety valve of the present invention in the closed position.

The subsurface safety valve of the present invention, generally designated V, is illustrated in FIGS. 1A, 1B, 1C and 1D commencing from the top of the safety valve V and extending downwardly as would be done when installed in a hydrocarbon producing well (not illustrated). The flow of well fluids, including hydrocarbons, is upwardly through a well flow conduit and the valve to the earth's surface in the conventional manner. The safety valve V provides a catastrophic occurrence protection of the well for shutting in the flow of hydrocarbon well fluids at a preselected location below the earth surface in the event of surface well head equipment malfunction or destruction.

The safety valve V includes a tubing retrievable valve housing or body, generally designated 10, which is connected in and forms a portion of the well conduit or tubing (not illustrated) for conducting the well fluids from the producing formation (not illustrated) to the earth's surface. Reference may be made to Knox U.S. Pat. No. 3,035,808 for an illustration of such an installation including the separate control fluid conduit. The tubular valve housing 10 includes, for ease of assembly, an upper tubular connection sleeve or sub 20 (FIG. 1A), an upper body member 22, an upper body connector sleeve 24 (FIG. 1B), an intermediate body member 26, an intermediate body connector sleeve 28 (FIG. 1C), a lower body member 30, a lower body connector sleeve 32 (FIG. 1D), and a lower tubing connector sleeve or sub 34. Other arrangements of the valve housing 10 may be employed for ease of assembly without departing from the scope of the present invention.

The upper sub 20 (FIG. 1A) is provided with a conventional internal thread or box connection **20*a* for connecting with the portion of the well conduit above the safety valve V in the usual manner. The upper sub 20 is also provided with threads 20*b* for securing the sub 20 with the body member 22 in the usual manner during assembly. To prevent leakage of fluid between the upper body member 22 and the upper sub 20 along threads 20*b*, a sealing O-ring 36 is carried by the upper sub 20. If desired, suitable anti-rotational pins (not illustrated) may be utilized to prevent inadvertent disengagement of the threads 20*b* in the usual manner. Engagement with a stop ring 21 limits rotational make-up or the sub 20 into the member 22**.

Figure 2A:
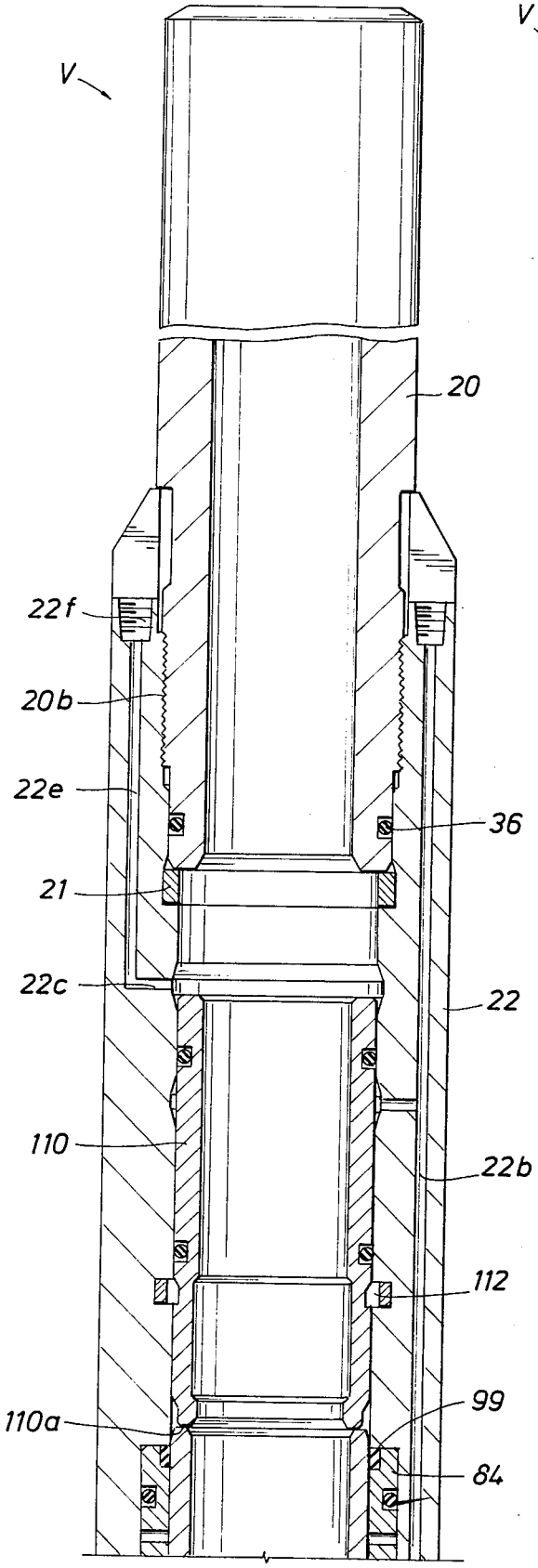
FIGS. 2A, 2B, 2C and 2D are views similar to FIGS. 1A, 1B, 1C and 1D, respectively, with the safety valve of the present invention locked in the open position.
Figure 2B:
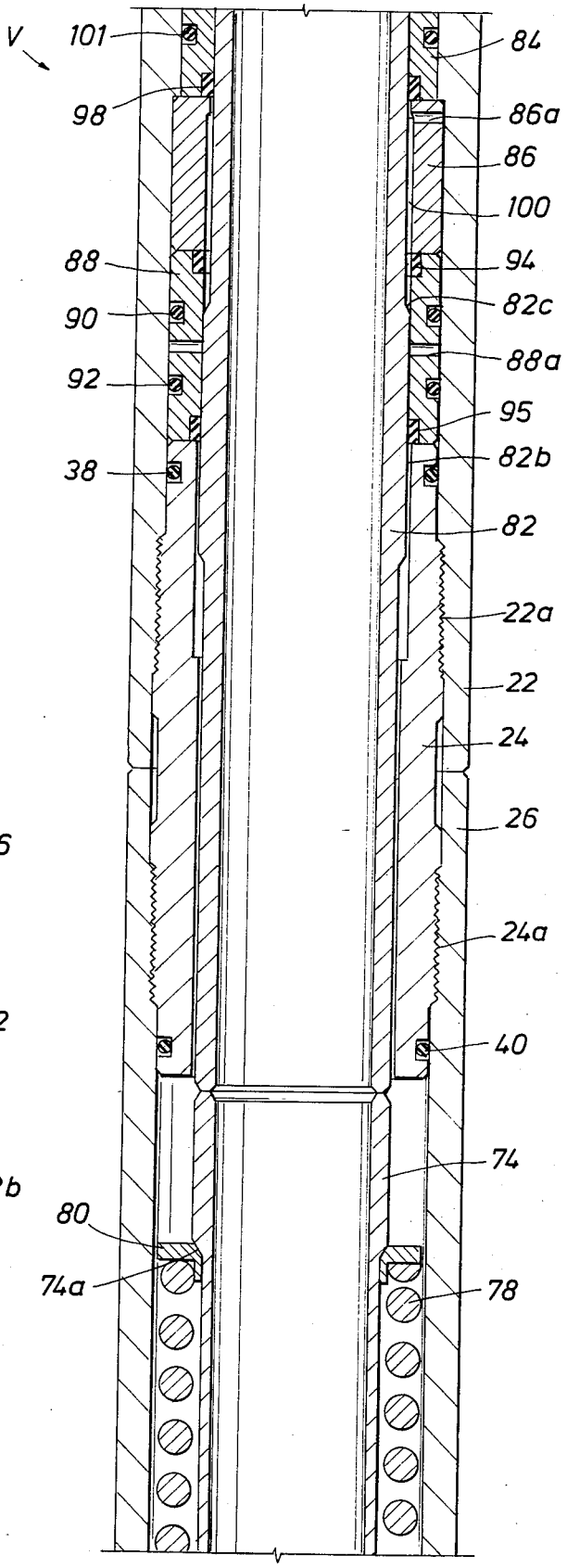

As illustrated in FIG. 2B, the upper tubular body member 22 is connected to the upper body connector sleeve by threads 22*a*. The upper body connector sleeve 24 is in turn connected to the intermediate tubular body member 26 by threads 24*a*. O-ring 38 prevents leakage of fluid along thread threaded engagement at 22*a* while O-ring 40 maintains leakage integrity of thread threaded engagement 24*a*.

Figure 2C:
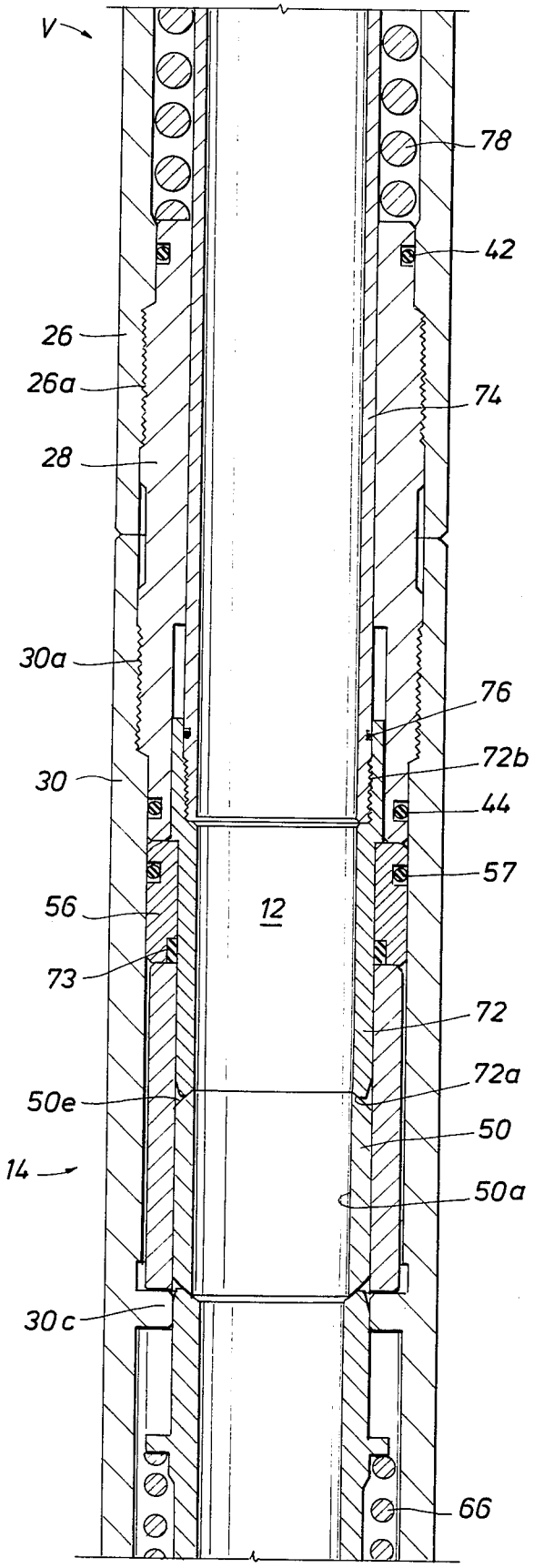
Figure 2D:
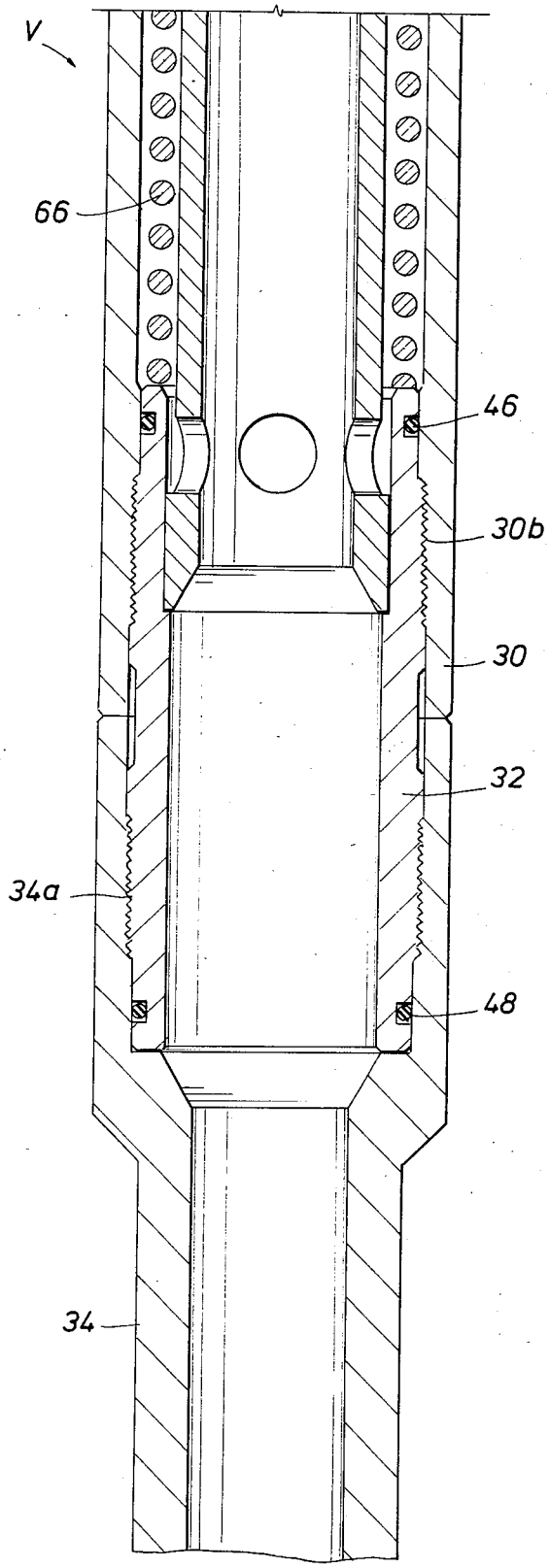

The intermediate body connector sleeve or internal coupling 28 (FIG. 2C) functions in a manner substantially identical to the upper body connector sleeve 24. Threads 26*a* secure the lower end of the intermediate body member 26 to the connector sleeve 28 while threads 30*a* connect with the lower body member 30. O-rings 42 and 44 prevent leakage along threads 26*a* and 30*a*, respectively, in the usual manner.

The lower body connector sleeve 32 (FIG. 1D) functions in a manner similar to connector sleeve 28 by securing with the lower body member 30 using helical threads 30*b*. Threaded engagement at 34*a* secures the lower tubing connector sleeve or sub 34 to the connector sleeve 32. O-rings 46 and 48 seal the lower connector sleeve with the lower body member 30 and lower sub 34 to prevent leakage of fluid therebetween. The lower sub 34 may be provided with suitable connection (not illustrated) such as a conventional helical thread for securing with the portion of the well tubing below the subsurface safety valve V, if desired.

The assembled valve housing 10 thus forms a central flow passageway or full opening bore, generally designated 12, through which well fluids may be communicated or flow substantially unrestricted from in the usual manner the lower sub 34 to the upper sub 20.

Figure 1B:
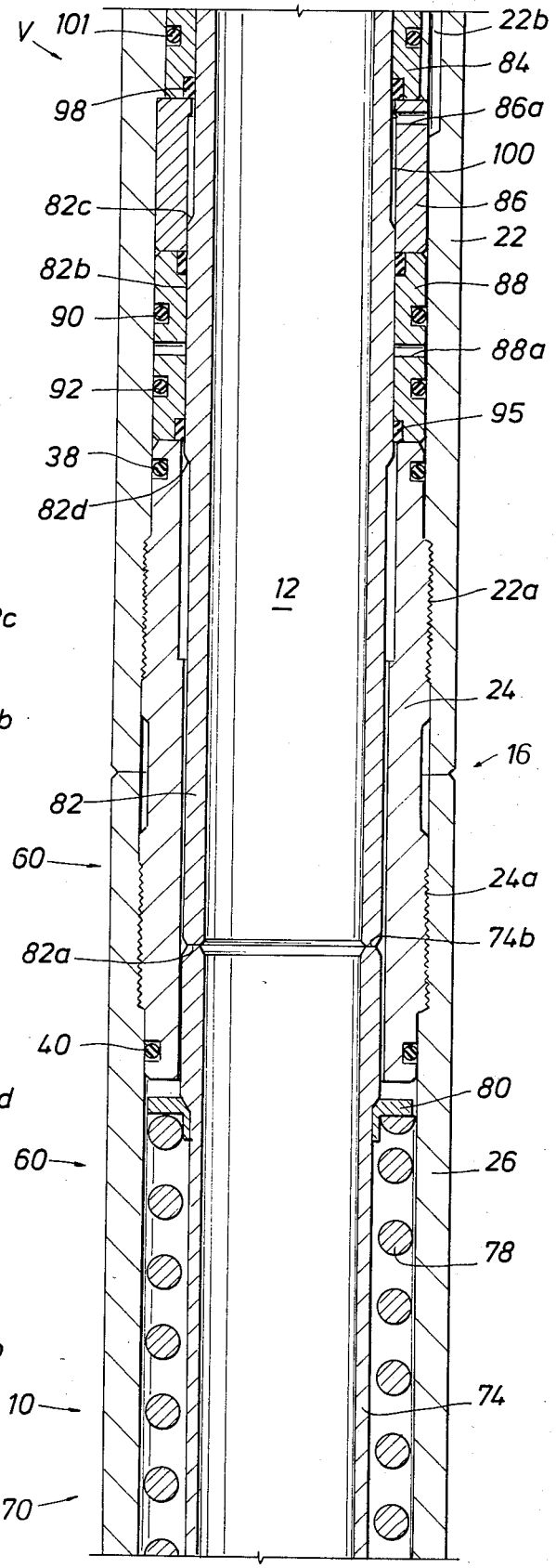
Figure 1C:
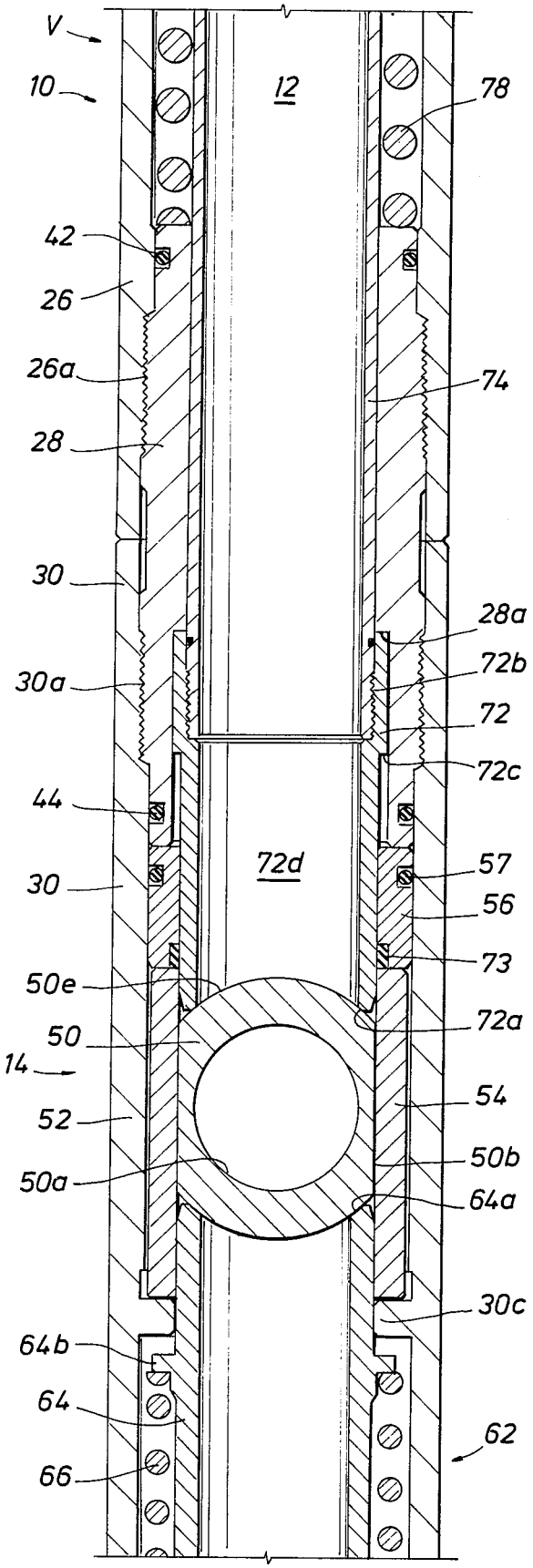

As best illustrated in FIG. 1C, a bore or flow closure means, generally designated 14, is positioned in the bore 12 for movement to and from an open position (FIG. 2C) for enabling flow of fluid through the bore 12 and a closed position (FIG. 1C) for blocking flow of fluid through the bore 12 of the valve V.

The disclosed bore closure means 14 includes a rotatable ball-type closure element 50 and two ball guiding or retainer members 52 and 54 which are disposed below the sealing and spacer ring 56. The spacer ring 56 is disposed between the retainers 52 and 54 and the housing sleeve 28 for preventing upward movement of the retainer 52 and 54. A collar 30*c* on the housing sleeve 30 prevents downward movement of the retainers 52 and 54.

The ball-type closure element 50 includes a flow opening or port 50*a* formed therethrough which when aligned with the bore 12 enables the desired flow of well fluids through the bore 12. When the ball 50 is rotated to the closed position of FIG. 1C, the port 50*a* is placed out of alignment with the bore 12 and the ball 50 serves to block off the flow of well fluids in the usual manner.

As best illustrated in FIG. 3, the retainer members 52 and 54 are provided with outer cylindrical surfaces 52*a* and 54*a* for fitting tightly within the tubular lower body member 30 below the ring 56 and above the collar 30*c*. The inner surfaces 52*b* and 54*b* of the ball mounting members 52 and 54 are substantially flat for placement adjacent the two parallel chordal flats 50*b* formed on the ball 50. The providing of the chordal flats 50*b* creates a clearance or openings into which the members 52 and 54 are assembled with the ball 50 prior to inserting the assembly into the sleeve 30. Each of the flat surfaces 52*b* and 54*b* of the mounting members 52 and 54 have aligned projecting eccentric ball mounting pins 52*c* and 54*c* positioned thereon which are received within the radially extending recesses 50*c* formed on each of the flats 50*b* of the ball 50 for co-acting to provide the desired cranking rotation as is well known in the art. Also formed on one or both chordal flats 50*b* is a rotational limit stop recess 50*d*.

As best illustrated in the sequence of FIGS. 4 through 6, the ball rotation limit stop recess 50*d* engages a co-acting rotational limit stop lug or lugs 52*d* and 54*d*, respectively formed on the ball mounting members 52 and 54 for preventing rotational over travel of the ball 50 in response to ball movement of a longitudinal distance greater than the prearranged or designed stroke needed to effect the quarter turn or ninety (90) degree rotational movement to the open position. In FIG. 4, the ball 50 is positioned in the closed position with the aligned crank pins 52*c* located below the center of the ball 50. The movement limit stop 52*d* is located below the ball 50 and with the recess 50*d* positioned above the stops 52*d* and 54*d*. As the center of the ball 50 is moved longitudinally downward, the aligned eccentric crank pins 52*c* and 54*c* engage the surfaces formed by the radial recess 50*c* to crank the ball to the fully aligned open position as illustrated in FIG. 5.

When the ball reaches the fully aligned open position, the rotation limit recess 50*d* formed on the chordal flat engages the rotational stop or projection 52*d* for preventing further rotational movement of the ball which would tend to cause it to over travel the desired ninety (90) degree operating rotation. The additional rotation results in flow throttling with attendant downstream flow impingement and resulting erosion which could damage the safety valve V. Continued longitudinal movement of the center of the ball 50 an additional distance relative to the crank pins 52*c* and to the stop 52*d* will move the ball to the full longitudinal stroke open position illustrated in FIG. 6. Note that the radially extending slot 50*c* is provided with a clearance taper at 50*c*′ (FIG. 5) to enable the ball 50 to move longitudinally relative to the pin 52*c* to provide for the overtravel with insures that sufficient longitudinal movement occurs to effect positive opening rotation of the ball 50.

To positively move the ball 50 longitudinally between the open and closed positions, an actuator or operator means, generally designated 16, is provided. The longitudinal movement of the ball 50 imparted by the operator means 16 co-acts with the eccentric pins 52*c* and 54*c* to effect the desired rotational motion, previously described, to operate the valve to the desired position. The actuator means 16 includes an upper movable actuator assembly, designated 60, and a lower movable actuator assembly or mechanism, designated 62.

Figure 1D:
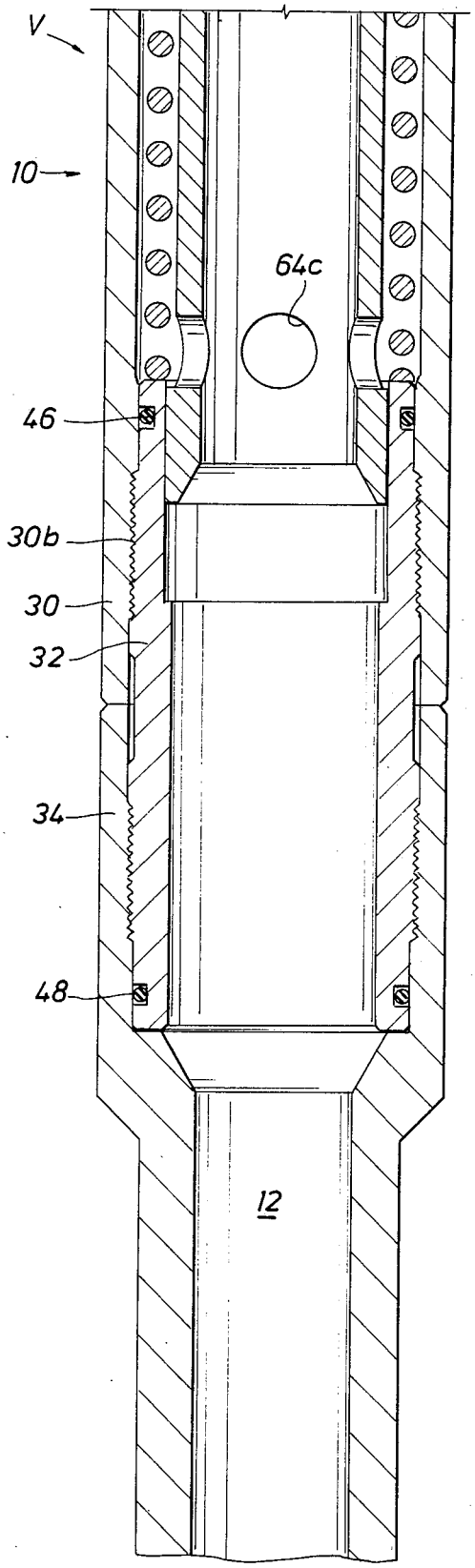

The lower actuator assembly 62 includes a lower actuator or ball follower sleeve 64 that is reciprocably mounted in the bore 12 below the ball 50 (FIGS. 1C and 1D). A suitable biasing spring 66 provides an upwardly urging on the movable sleeve 64 to maintain the arcuate upper annular shoulder 64*a* in engagement with the ball 50 and to urge the ball 50 to the upper or rotated closed position as illustrated in FIGS. 1C and 4. The coil spring 66 is concentrically positioned outwardly of the sleeve 64 between the lower housing connector sleeve 32 and an annular collar 64*b* formed on the sleeve member 64. The lower actuator sleeve 64 is ported at 64*c* to enable fluid communication between the area adjacent the spring 66 and the bore 12 of the housing 10 and thereby prevent inadvertent formation of any undesired pressure differential.

Disposed above the ball 50 is the upper actuator mechanism 60. The upper actuator mechanism 60 includes reciprocating actuator sleeve assembly 70 formed by the tubular upper ball seat 72 and tubular seat extension 74 which is illustrated in the upper position in FIGS. 1A, 1B and 1C and in the lower position in FIGS. 2A, 2B and 2C. The valve seat 72 is provided with a downwardly facing arcuate annular shoulder 72*a* which engages the ball 50 for maintaining an annular fluid sealing contact with the outer spherical surface 50*e* of the ball 50 at all times. Alignment of the ball port 50*a* with a central flow opening 72*d* of the seat 72 enables flow through the bore 12 (FIG. 2C) while the ball 50 will block flow through the seat 72 when the ball port 50*a* is out of alignment. To limit further upward movement of the seat 72 and ball 50 when the ball 50 is in the closed position, the annular seat 72 engages an annular shoulder 28*a* (FIG. 1C) of the housing connector sleeve 28. This engagement of the annular shoulder 72 and 28*a* also serves as a back-up seal for blocking leakage of fluid in the event of failure of the seal 73. The tubular seat 72 is secure to the upper seat extension 74 by threaded engagement at 72*b* while O-ring 76 blocks leakage of fluid along the threaded engagement at 72*b* (FIG. 1C). The ball securing ring 56 is disposed concentrically outwardly of the seat 72 and serves as a guide bushing for the longitudinal operating movement of the seat 72. An O-ring 57 blocks passage of fluid between the ring 56 and the housing sleeve 30 while seal 73 prevents leakage between the ring 56 and the reciprocating seat 72. These two seals plus the seal of the seat 72*a* with the spherical surface 50*e* of the ball 50 prevent flow of fluid through the valve other than through the aligned port 50*a*. Engagement of the annular shoulder 72*c* of the seat 72 with the ring 56 also serves as the lower longitudinal movement limit stop of the upper actuator mechanism 60 when sufficient longitudinal movement including overtravel has occurred to insure positive rotation of the ball 50. Because of this longitudinal limit stop arrangement, manufacturing and assembly tolerances may be relaxed, with attendant savings, while insuring positive operation.

The upper actuator seat extension 74 is urged to the upper position by a biasing spring 78 concentrically disposed between the tubular extension 74 and the housing member 26. The spring 78 is supported at its lower end by the housing connector sleeve 28 and engages a spring retainer 80 mounted on the extension 74 below the downwardly facing tapered annular shoulder 74*a*. Preferably the upper spring 78 is made stronger than the lower spring 66.

The upper actuator mechanism 60 further includes the longitudinally movable pressure responsive operator sleeve 82 (FIGS. 1A and 1B) which is disposed above the actuator sleeve extension 74. A downwardly facing annular shoulder 82*a* of the actuator sleeve 82 engages an upwardly facing annular shoulder 74*b* formed on the seat extension 74 for forcing the extension 74, the seat 72 and the ball 50 to the lower or open position in a manner that will be explained hereinafter. The sleeve 82 is provided with a larger constant outer diameter portion 82*b* (FIG. 1B) which provides an upwardly facing annular shoulder 82*c* and downwardly facing annular shoulder 82*d*. As will be explained in greater detail hereinafter, the upwardly facing annular shoulder 82*c* forms a pressure responsive surface effective area on which control fluid pressure will urge the sleeve 82 to move downwardly for effecting opening rotation of the ball 50 when desired.

Concentrically mounted about the concentrical sleeve 82 and above the body connector 24 are a plurality of fixed actuator rings 84, 86 and 88. The ring 88 is disposed immediately above the housing connector sleeve 24 and secured against donward movement engagement therewith. Ring 88 has a radial flow port 88*a* extending radially therethrough and carries a pair of O-rings 90 and 92 for effecting seals with the housing member 22 above and below the port 88*a*. The ring 88 further carries a pair of seals 94 and 95 for sealing between the ring 88 and the greater outer constant diameter portion 82*b* of the reciprocating operator 82.

The fixed ring 86 is also provided with a radial extending port 86*a* adjacent engagement with the upper seal carrying ring 84. The port 86*a* communicates with a control fluid passage 22*b* (FIGS. 1A and 1B) formed in the housing member 22. The passage 22*b* is provided at its upper end with the threaded opening 22*c* for connecting with a control fluid conduit (not illustrated) extending to the surface for receiving the pressurized control fluid from the surface for the moving the subsurface safety valve to the open position. The pressurized control fluid is received at the threaded inlet 22*c* and communicated through the conduit 22*b* and port 86*a* to the reciprocating actuator member 82. The pressurized control fluid acts upon the upwardly facing annular shoulder 82*c* for forcing the sleeve 82 to move downwardly. The downward movement of the sleeve 82 is transmitted through the seat extension 74 and seat 72 to the ball 50 for effecting its longitudinal downward movement and thereby providing the opening rotation.

The control fluid communicated through the port 86*a* is communicated into an expansible chamber 100 formed between the actuator sleeve 82 and the ring 86 (FIG. 1B). The expansible chamber 100 is sealed on its lower end by the seals 94 and 95 and its upper end by seals 98 (FIG. 1B) and 99 (FIG. 1A) carried by the ring 84. The ring 84 is also sealed to the housing sleeve 22 by the O-ring seals 101 and 102. Disposed between the seals 94 and 98 are one or more plurality of radial pressure equalizing ports 84*a*.

Disposed in the bore 12 immediately above the operator sleeve 82 is the shiftable lockout sleeve 110. The lockout sleeve 110 is longitudinally movable between the upper inoperative position (FIG. 1A) and a lower locking position (FIG. 2A) where it forces the actuator sleeve 82 to the lower position and thereby effecting opening rotation of the ball 50. Then the lockout sleeve not only serves to lock the ball 50 in the open position, but also serves as back-up to open the valve V. The locking sleeve 10 is provided with a downwardly facing lower annular shoulder 110*a* which is adapted to engage the actuator sleeve 82 for effecting its downward movement and thereafter retaining the actuator sleeve 82 in the lower position. For shifting the lockout sleeve 110 to the lower position, a recess 110*b* is provided on the inner surface for securing to a wireline shifting tool (not illustrated). Such wireline shifting tools are well known, are commercially available from a number of sources and need not be described in greater detail herein.

The lockout sleeve 110 is provided with a downwardly facing tapered annular shoulder 110*c* which engages the detent 112 for maintaining the lockout sleeve 110 in the inoperative or upper position. A shear pin (not illustrated) may be employed to secure the lockout sleeve 110 with the fixed body ring 21 to also prevent inadvertent movement of the sleeve 110. When the shifting tool moves the locking sleeve 110 to the lower position, the tapered surface 110*c* forces the radially expansible gapped ring or detent 112 to expand and enable passage of the lockout sleeve 110 adjacent thereto. Such movement continues until a recess 110*d* is positioned adjacent the expanded detent 112 which enables the detent 112 to move radially inwardly for locking the lockout sleeve 110 in the lower position (FIG. 2A). Because of the planned longitudinal overtravel on the seat 72, the longitudinal distance between the recess 110*d* and shoulder 110*c* is not as critical and tolerances may be relaxed with an expected cost savings.

The locking sleeve 110 carries O-rings 114 and 116 for effecting sliding seals between the locking sleeve 110 and the housing member 22. When the locking sleeve 110 is in the upper position, the seal 116 is positioned below the second control fluid conduit port 22*d* formed in the housing sleeve 22 for preventing leakage in that direction. The O-ring 114 is disposed above the port 22*d* for blocking leakage of fluid between the locking sleeve 110 and the housing 22 in that direction. Also formed in the housing sleeve 22 is a second control fluid conduit 22*e* having a threaded inlet opening 22*f* similar to the threaded opening 22*c* of the passage 22*b*, but which is connected to a separate or second control fluid conduit. The passage 22*e* also communicates to the area of the locking sleeve 110 between the seals 116 and 114. During normal operation of the safety sleeve V, the ports 22*e* and 22*d* would be in flow communication due to the absence of a seal on the locking sleeve 110 for separating the two ports and either conduit may be used to pressure the chamber 100 to rotate open the ball 50. When the locking sleeve 110 is moved to the lower position, the upper seal 114 is shifted down sufficiently to separate the port 22*d* from the passage 22*e* which communicates with the bore 12 while the port 22*d* is isolated from the bore 12. The passage 22*e* is used to transmit the control fluid pressure from the surface to a through the flow line movable back-up or supplemental valve operably secured in the bore 12 of the housing 10.

Use and Operation of the Present Invention

The subsurface safety valve V is assembled in the manner illustrated in FIG. 1 and taken to the well site for installation in essentially that condition. At the well site, the lower threaded connector (not illustrated) and the upper threaded connector 28 are made up in the well conduit or tubing in order that the housing 10 will form a portion of the flow passage in the well at a desired subsurface location. The control fluid conduits (not illustrated) are then connected to the threaded openings 22*c* and 22*f* and are run simultaneously with the well tubing in lowering the safety valve V to its desired subsurface operating location in the well. If only a single control fluid conduit is desired it is connected to the opening 22*f* and the opening 22*c* is plugged.

When it is desired to enable flow from the well, the control fluid in the conduit connected to threaded inlet port 22*c* preferably has its pressure increased. This increased fluid pressure is communicated to the port 22*d* but the seals 114 and 116 prevent any effect of this increased pressure on the locking sleeve 110. However, the increased control fluid pressure communicated through the port 86*a* in the ring 86 urges on the upwardly facing annular shoulder 82*c* forming the expansible chamber 100 for forcing the upper actuator sleeve 82 downward. The downward force on the actuator sleeve 82 brings it into engagement with the valve seat, extension 74, the valve seat 72 and the ball 50. As the pressure of the control fluid is increased, the urging of the spring 78 above the ball and the spring 66 below the ball is overcome for moving the actuator sleeve 82 downwardly. This downward movement effects the opening rotation of the ball 50 from the closed position of FIGS. 1 and 4 to the rotated open position illustrated in FIG. 5 and onto the full open position illustrated in FIGS. 2C and 6.

Should the supply of control fluid pressure be interrupted for any reason, the urging of the springs 78 and 66 will urge the actuator mechanism to the upper position. Since the spring 78 is preferably made somewhat stronger than the lower spring 66, it will tend to move the seat 72, seat extension 74 and pressure responsive actuator sleeve 82 to the upper position. The lower spring 66 provides sufficient urging on the ball follower sleeve 64 to maintain the ball 50 in sealing contact with the seat 72 during closing.

When it is desired to lock the safety valve V in the open position, a wireline tool is run down the bore of the well tubing and latched into the recess 110*b* of the locking sleeve 110 in the conventional manner. The initial downward movement of the locking sleeve 110 will radially expand the detent 112 to enable movement of the locking sleeve 110 and bring the annular shoulder 110*a* into engagement with the pressure responsive actuator sleeve 82. The downward movement imparted by the wireline actuation tool to the locking sleeve 110 is thereby imparted to the actuator sleeve 82 for forcing it to move downwardly and thereby effecting opening rotation of the ball 50 in the manner previously described. When the wireline operation has moved the recess 110*d* adjacent the detent 112, the detent will radially contract or constrict into the recess 110*d* and prevent subsequent upward movement of the locking sleeve 110. The wireline tool may then be released from the recess 110*b* and retrieved back to the surface. A supplemental or backup wireline retrievable subsurface safety valve may be installed in the bore 12 of the safety valve V. The supplemental valve may be controlled from the surface using the control fluid passage 22*e* for communicating the control fluid into the bore 12 of the safety valve V.

The foregoing disclosure and description of the invention are illustrative and explanatory thereof, and various changes in the size, shape and materials, as well as in the details of the illustrated construction may be made without departing from the spirit of the invention.

What is claimed is:

1. A subsurface safety valve for use in controlling flow in a well conduit providing a desired fluid flow path in the well, including:

a valve housing having means for connecting said valve housing in a well conduit providing the desired fluid flow path, said valve housing having a flow passage formed therethrough which communicates with the well conduit when connected therewith to form a portion of the well conduit at a desired subsurface location in the well;

flow closure means disposed in said flow passage for movement to and from a closed position for blocking flow of fluid through said flow passage and an open position for enabling flow of fluid through said flow passage;

operator means mounted with said housing for moving said flow closure means longitudinally in said flow passage to and from the open and closed positions; and said flow closure means including:

a ball-type flow closure element having a flow enabling port extending therethrough which when aligned with said flow passage enables desired flow and when said port is disposed out of communication with said flow passage, said ball-type flow closure element blocks flow through said flow passage, said ball-type flow closure element having a pair of parallel flats formed thereon, said flow enabling port forming a longitudinal axis that is disposed between and parallel to said flats;

a pair of ball-type flow closure element operating retainers fixedly secured in said flow passage, one of said retainers positioned adjacent one of said parallel flats and the other of said retainers positioned adjacent the other of said parallel flats;

at least one of said adjacent operating retainers and flats having a first co-acting means for rotating said ball-type flow closure element to and from the open and closed position in response to relative longitudinal movement of said ball-type flow closure element relative to said operator guides a prearranged longitudinal distance; and at least one of said adjacent operating retainers and one of said flats having a second co-acting means for maintaining said flow enabling port in the open position aligned with said flow passage during longitudinal movement of said ball-type flow closure element greater than the prearranged longitudinal distance required to effect rotation to the open position.

2. The subsurface safety valve as set forth in claim 1, wherein:

said ball-type closure element having a spherical outer sealing surface; and said operator means having a tubular seat forming a central opening, said seat disposed adjacent to and in sealing engagement with said ball-type closure element, said flow enabling port alignable with said central opening of said tubular seat and said flow passage to enable flow through said flow passage.

3. The subsurface safety valve as set forth in claim 2, wherein:

said operator means having a pressure responsive surface for moving said ball-type closure member longitudinally in said flow passage to align said flow enabling port with said flow passage in response to increased fluid pressure urging on said pressure responsive surface; and means for communicating a control fluid pressure to said pressure responsive surface independent of the well fluid pressure in said flow passage for moving said ball-type closure member longitudinally in said flow passage a greater longitudinal distance than the prearranged longitudinal distance required to align said flow enabling port with said flow passage.

4. The subsurface safety valve as set forth in claim 2, wherein:

said operator means including a tubular operating sleeve movably disposed in said flow passage above said tubular seat, said tubular operating sleeve forming a pressure responsive annular surface for moving said tubular seat and said ball-type closure element longitudinally downward in said flow passage to align said flow enabling port with said flow passage in response to increased fluid pressure urging on said pressure responsive surface; and means for communicating a control flow pressure to said pressure responsive surface independent of the well fluid pressure in said flow passage for moving said ball-type closure member longitudinally in said flow passage a greater longitudinal distance than the prearranged longitudinal distance required to align said flow enabling port with said flow passage.

5. The subsurface safety valve as set forth in claim 4, including:

a locking sleeve movably disposed in said flow passage above said tubular operator sleeve, said locking sleeve initially in an inactive position and movable to a locking position for holding said tubular operator to position said ball-type closure with said flow enabling port aligned with said flow passage; and said locking sleeve shiftable to the locking position a longitudinal distance sufficient to move said operator sleeve a longitudinal distance greater than the prearranged longitudinal distance required to effect rotation of said ball to the open position.

6. The subsurface safety valve as set forth in claim 5, wherein:

said housing having a port formed therein;

said locking sleeve having seal means for blocking communication of said port and said flow passage when said locking sleeve is in the inactive position, said locking sleeve in the locking position positioning said seal means to enable communication between said port and said flow passage; and means for communicating a control fluid pressure to said port independent of the flow passage.

7. The subsurface safety valve as set forth in claim 6, wherein:

said seal means of locking sleeve in the inactive position enabling communication of said port and said means for communicating a control fluid pressure to said pressure responsive surface, said locking sleeve in moving to the locking position locating said seal means to block communication of said port and said means for communicating a control fluid pressure to said pressure responsive surface.

8. The subsurface safety valve as set forth in claim 4, wherein:

said tubular seat forms a downward movement limit stop for limiting downward movement of said tubular seat and said ball after said ball has moved a longitudinal distance greater than the prearranged longitudinal distance required to align said flow enabling port with said flow passage.

* * * * *